United States Patent [19]

Murata

[11] Patent Number: 4,977,326

[45] Date of Patent: Dec. 11, 1990

[54] LUMINESCENT SCREEN

[75] Inventor: Yasushi Murata, Saitama, Japan

[73] Assignee: Pioneer Electronic Corporation, Tokyo, Japan

[21] Appl. No.: 383,548

[22] Filed: Jul. 24, 1989

[30] Foreign Application Priority Data

Jan. 17, 1989 [JP] Japan ..... 1-8392

[51] Int. Cl.[5] ..... G21K 4/00

[52] U.S. Cl. ..... 250/483.1; 250/486.1

[58] Field of Search ..... 250/486.1, 484.1, 327.2, 250/483.1

[56] References Cited

U.S. PATENT DOCUMENTS 3,344,276 9/1967 Balding ..... 250/486.1

4,752,557 6/1988 Tsuchino et al. ..... 250/483.1

*Primary Examiner*—Carolyn E. Fields

*Attorney, Agent, or Firm*—Fleit, Jacobson, Cohn, Price, Holman & Stern

[57] ABSTRACT

A luminescent screen includes a screen plate containing a substance capable of emitting luminescent light in response to stimulating light applied thereto. The screen plate is made of a resin containing a planar assembly of hollow column-shaped members having sides thereof fixed together, the column-shaped members defining respective elements. Since light emission interference does not occur between the elements, the brightness of the screen is increased. The hollow column-shaped members in the screen plate make the screen mechanically strong.

2 Claims, 1 Drawing Sheet

LUMINESCENT SCREEN

BACKGROUND OF THE INVENTION

1. Field of the Invention

The present invention relates to a luminescent screen, and more particularly to a luminescent screen having a screen plate containing a substance capable of emitting light in response to stimulating light applied thereto.

2. Description of the Prior Art

There are known display systems having a luminescent screen comprising a screen plate which contains a substance (a luminescent substance) capable of fluorescence or phosphorescence in response to stimulating light such as ultraviolet radiation, visible light, near-infrared radiation, or the like, the fluorescent substance comprising a piperidinium tetra (benzoyltrifluoroacetone) europium complex, for example. The stimulating light is applied to the screen plate to enable the screen plate to display an image.

Heretofore, the screen plate has generally been in the form of a transparent plastic plate having smooth surfaces. As shown in FIG. 1 of the accompanying drawings, when stimulating light is applied to a plastic screen plate 30, luminescent light is emitted from a luminescent substance (indicated by a star-shaped symbol) and scattered in every direction as indicated by the broken lines. Since the emitted light is totally reflected by interfacial surfaces of the screen plate 30 and propagated in the screen plate 30, the efficiency with which the applied stimulating light is utilized is low, and the intensity of luminescent light emitted toward the display side of the screen plate is so low that the screen as viewed by the viewer is relatively dark. The plastic screen plate is also disadvantageous in that it suffers a color crosstalk due to an emission interference, and it is mechanically weak.

SUMMARY OF THE INVENTION

In view of the aforesaid drawbacks of the conventional luminescent screen, it is an object of the present invention to provide a luminescent screen which emits luminescent light of an increased intensity toward a viewer for a greater degree of screen brightness in response to a reference intensity of stimulating light applied to the screen, which eliminates a color crosstalk that would otherwise be caused by an emission interference, and which is mechanically strong.

According to the present invention, a luminescent screen comprises a screen plate containing a substance capable of emitting luminescent light in response to stimulating light applied thereto, the screen plate being made of a resin containing a planar assembly of hollow column-shaped members having sides thereof fixed together.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
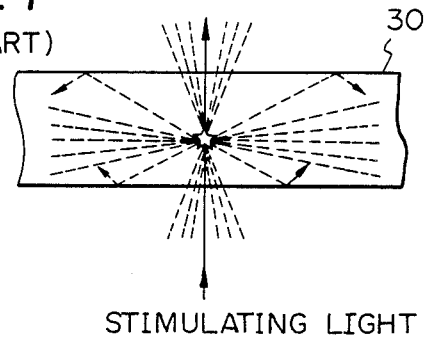
Fig. 1 (PRIOR ART)
FIG. 1 is a fragmentary cross-sectional view of a conventional luminescent screen.
Figure 2:
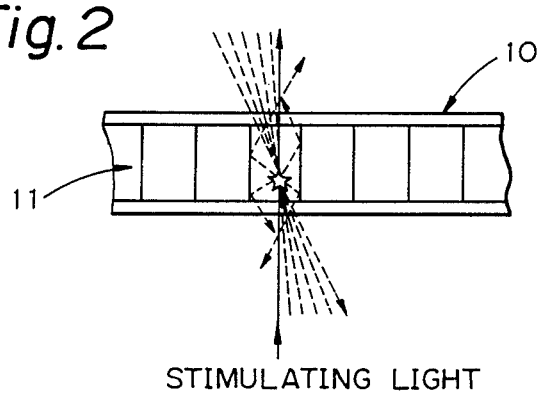
FIG. 2 is a fragmentary cross-sectional view of a luminescent screen according to the present invention.
Figure 3:
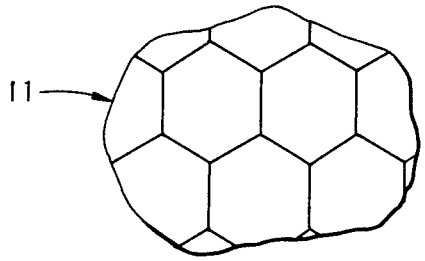
FIG. 3 is a fragmentary plan view of the luminescent screen shown in FIG. 2.

As shown in FIGS. 2 and 3, a luminescent screen according to the present invention includes a screen plate 10 made of a resin such as PMMA or the like which contains a luminescent substance. The screen plate 10 comprises a plate having a plurality of honeycomb-shaped, hollow hexagonal column-shaped members, i.e., a honeycomb core 11. The screen plate 10 is manufactured by casting the resin in a flowable state into a mold and letting the resin be solidified in the mold. It is important therefore that no air bubbles be entrained in the resin when the honeycomb core 11 is placed in the resin. The honeycomb core 11 should preferably be made of metal if the mechanical strength of the screen plate 10 should be increased, or should preferably be made of black hard plastic if the contrast of images displayed on the screen should be increased. It is also effective to make the honeycomb core 11 of hard plastics which is of white or light color other than the three primaries (R, G, B). As shown in FIG. 2, elements which are defined by the respective hollow hexagonal column-shaped members correspond respectively to pixels on the screen. Stimulating light (indicated by the solid line) such as ultraviolet radiation or the like is applied as a spot to the screen while the spot is being two-dimensionally scanned over the screen. In each of the elements, a luminescent substance indicated by the star-shaped symbol is responsive to the applied stimulating light for emitting luminescent light as indicated by the broken lines. As shown in FIG. 2, the column-shaped members have a thickness smaller than the screen plate and are buried in the screen plate.

The honeycomb core 11 disposed in the screen plate 10 is effective in preventing the emitted luminescent light from being scattered laterally, and in guiding the light emission in the direction in which the light passes through the screen plate 10 or the direction opposite to the direction in which the stimulating light is applied. Therefore, the efficiency with which the stimulating light is utilized is increased. The intensity of emitted luminescent light directed toward the viewer (on the side of the screen through which the emitted light is passed if the screen is used in a rear projector, or on the side of the screen through which the stimulating light is applied if the screen is used in a front projector) is increased, so that the screen brightness with respect to a reference intensity of stimulating light is higher. Since no emission interference occurs between the pixel elements of the screen, no color crosstalk is developed on the screen. The honeycomb core 11 makes the screen plate 10 highly rigid.

While each of the elements of the honeycomb core 11 is preferably of a hexagonal cross-sectional shape for increased mechanical strength of the screen, as shown in FIG. 3, the elements may be of any of other cross-sectional shapes such as another polygonal shape or a circular shape.

With the present invention, as described above, the screen plate is made of a resin containing a planar assembly of hollow column-like members having sides thereof fixed together. Therefore, luminescent light emitted in each of the column-shaped members in response to stimulating light applied to the screen is not scattered laterally into the other column-shaped members. The efficiency with which the stimulating light is utilized is increased, and the intensity of emitted luminescent light directed toward the viewer is also increased, so that the screen brightness with respect to a reference intensity of stimulating light becomes higher. Since no emission interference occurs between the pixel elements of the screen, no color crosstalk is developed on the screen. The planar assembly makes the screen plate highly rigid.

Although a certain preferred embodiment has been shown and described, it should be understood that many changes and modifications may be made therein without departing from the scope of the appended claims.

What is claimed is:

1. A luminescent screen comprising:

a screen plate made of a mixture of a transparent resin and a luminescent substance dispersed in said transparent resin, said luminescent substance being capable of emitting luminescent light when stimulating light is applied thereto; and a planar assembly of hollow column-like members having sides thereof intimately fixed together to adjacent members along a height of the members, said planar assembly having a thickness smaller than that of said screen plate and being buried in said screen plate, said resin and luminescent substance filling the interior of said members.

2. A luminescent screen according to claim 1, wherein each of said column-like members has a hexagonal cross-sectional shape.

* * * * *